United States Patent [19]

Gerber

[11] 4,104,498

[45] Aug. 1, 1978

[54] APPARATUS FOR AND METHOD OF INDUCTION HEATING OF METAL PLATES WITH HOLES

[75] Inventor: Howard L. Gerber, Park Forest, Ill.

[73] Assignee: The Continental Group, Inc., New York, N.Y.

[21] Appl. No.: 700,494

[22] Filed: Jun. 28, 1976

[51] Int. Cl.[2] ..... H05B 5/18

[52] U.S. Cl. ..... 219/10.43; 219/10.57; 219/10.79

[58] Field of Search ..... 219/10.79, 10.53, 10.49, 219/10.43, 10.41, 10.57, 7.5; 336/83, 73

[56] References Cited

U.S. PATENT DOCUMENTS

| | | | |
|---|---|---|---|
| 2,024,906 | 12/1935 | Bennett | 219/10.41 |
| 2,151,035 | 3/1939 | Kennedy | 219/10.79 |
| 2,314,865 | 3/1943 | Bierwirth | 219/10.79 |
| 2,572,646 | 10/1951 | Menzel et al. | 219/10.79 |
| 2,577,113 | 12/1951 | Dunsford | 219/10.79 |
| 2,777,041 | 1/1957 | Dustman | 219/10.79 |
| 3,737,613 | 6/1973 | Gillock | 219/10.43 |
| 3,755,644 | 8/1973 | Lewis | 219/10.79 |
| 3,823,589 | 7/1974 | Tikhonovich et al. | 219/7.5 |
| 3,849,625 | 11/1974 | Trine | 219/10.75 |
| 3,980,853 | 9/1976 | Morisaki | 219/10.79 |

*Primary Examiner*—Bruce A. Reynolds
*Attorney, Agent, or Firm*—Charles E. Brown

[57] ABSTRACT

There has been developed end units for cans of the easy opening type wherein end panels of the end units are provided with patterns of holes to facilitate the dispensing of a product. The holes are closed by means of strips, preferably formed of plastics material, overlying the holes and being bonded to the metal of the end units adjacent the holes. It is preferred that the bonding of the strips be effected by heat. A special induction heater has been constructed which induces into the metal of the area to where the strips are to be bonded electrical energy which results in the heating of the metal. The heater is particularly constructed so as to compensate for the holes in the metal of the end units and thus a uniform heating of the metal over the area to which the strip is to be applied can be effected.

16 Claims, 7 Drawing Figures

H.F. GENERATOR
66
10
11
12
13
14
15
16
17
18
20
22
23
24
25
26
27
28
36
37

APPARATUS FOR AND METHOD OF INDUCTION HEATING OF METAL PLATES WITH HOLES

This invention relates in general to new and useful improvements in induction heating, and more particularly to a heater specifically constructed for the uniform heating of metal plates having patterns of holes therein and the method of utilizing such a heater.

There has been developed an easy opening end unit for cans wherein the dispensing opening is in the form of a plurality of holes arranged in a predetermined pattern. These holes are initially closed by a strip of plastics material which is bonded to the face of the end panel surrounding the holes.

In the past there has been developed induction heaters for heating various portions of containers and closures therefore. However, the heating of the perforated metal sheet or plate posed an entirely different problem. It will be readily apparent that the tendency of a heater of the induction heating type is to generally uniformly heat a surface. It is not, however, desired to heat the "holes". Further, it is desired to heat only that surface of the sheet material of the end unit to which the sealing strip is to be bonded. Therefore, in accordance with this invention, there has been developed a special induction heater and a method of utilizing the same.

One of the principle features of the invention is the heater per se and more particularly the nosepiece of the heater and the manner in which high frequency electrical energy is transmitted into the nosepiece. In accordance with this invention, the electrical energy is concentrated in the nosepiece from a single turn secondary winding of a transformer, which winding is in the form of a tubular body having an axially extending slot extending the full height thereof. The slot is in the form of an air gap with the induced current travelling mainly in the slot up to the nosepiece. The nosepiece, in turn, is provided with a slot aligned with the slot in the secondary so as to receive current therefrom.

In accordance with this invention, current is primarily directed into the nosepiece through the slot therein, which slot is filled with a ferrite filler compound. Transverse current flow in the nosepiece to opposite sides of the slot in the nosepiece is determined by the width of the slot. Accordingly, the width of the slot may be varied to control the flow of current.

In a like manner, it has been found that concentration of current in certain portions of the face of the nosepiece can be controlled by forming recesses in the face. In addition, it has been found that transverse flow of current towards peripheral portions of the nosepiece can be effected by intersecting the slot in the nosepiece with other slots extending transversely of the main slot.

Concentrated flow of electrical energy to the nosepiece is also effected by means of a ferrite core which is positioned within the single turn secondary or core form.

Another feature of the invention is the forming of the periphery of the single turn secondary core form with a plurality of fins which define between them slots in which the multi-turn primary winding is seated. The relationship of the primary to the secondary is such that the current induced into the secondary is concentrated primarily along the slot with a smaller amount of induced current flowing on the inside of the coil form with the ferrite core providing a large inductance thereby forcing the major portion of the induced current on the inside of the coil form to the nosepiece.

In accordance with this invention, the particular pattern of holes in the area of the end unit which is to be heated is determined, afterwhich the nosepiece of the heater is specifically designed to provide for a uniform heating of the metal over the predetermined area. Further, the metal, by skin effect, is heated primarily on the surface thereof opposing the heater. Immediately after the end unit has been heated, the sealing strip is applied thereto in a known manner so as to effect the necessary sealing of the sealing strip to the heated surface of the end unit.

With the above and other objects in view that will hereinafter appear, the nature of the invention will be more clearly understood by reference to the following detailed description, the appended claimed subject matter, and the several views illustrated in the accompanying drawings.

IN THE DRAWINGS

Figures 1, 2, 3:
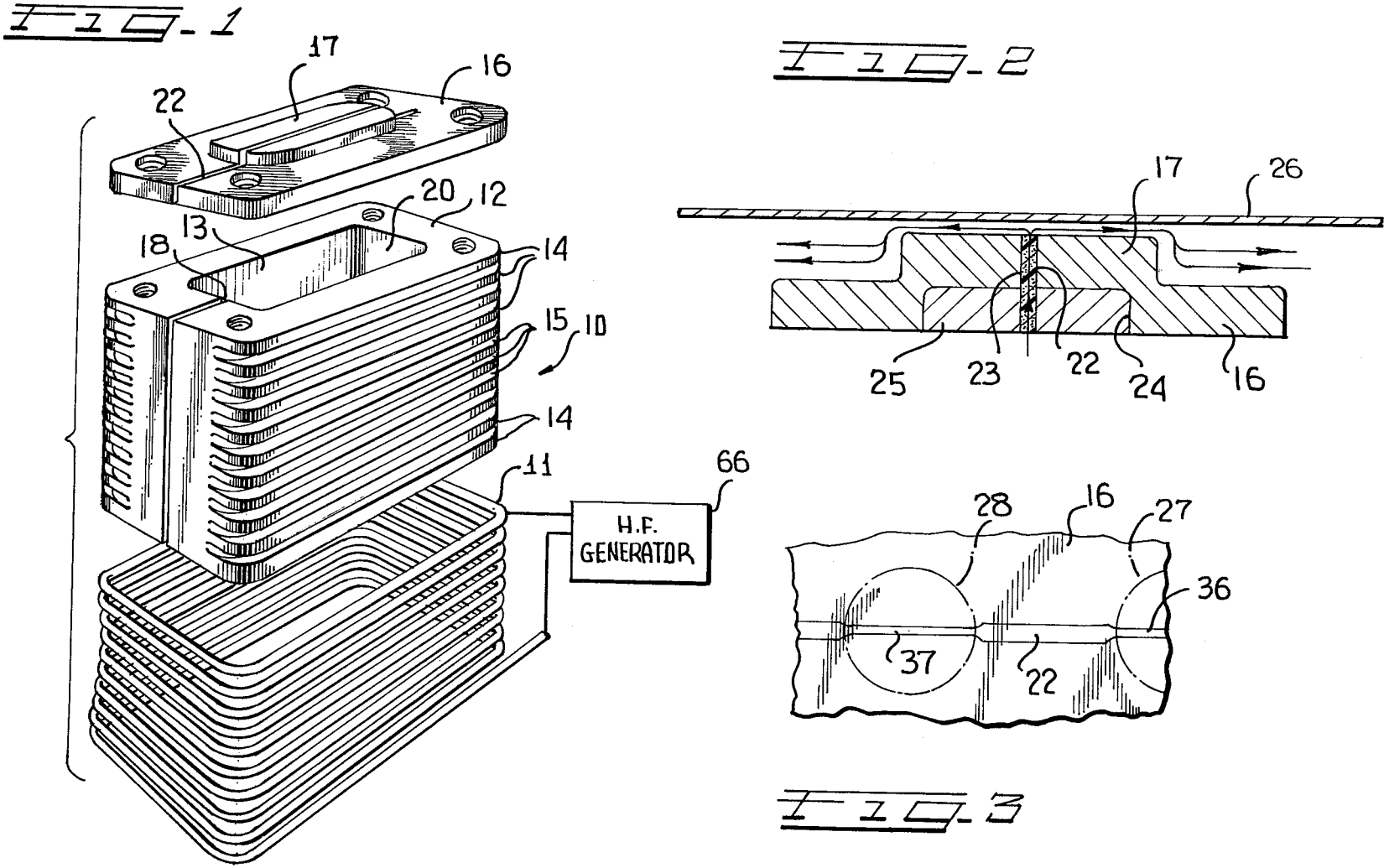
FIG. 1 is an exploded perspective view of the flux concentrator or heater formed in accordance with this invention.
FIG. 2 is an enlarged fragmentary transverse sectional view through the nosepiece of FIG. 1 and shows the magnetic flux path therefrom in conjunction with a metal plate being heated.
FIG. 3 is a fragmentary plan view of the nosepiece on a large scale showing the variation in the width of the slot in the nosepiece in accordance with the arrangement of holes in the metal sheet to be heated.

Referring now to the drawings in detail, it will be seen that the flux concentrator or heater formed in accordance with this invention is generally identified by the numeral 10 and is illustrated in an exploded condition in FIG. 1. The heater 10 includes a transformer in the form of a multi-turn primary coil 11 which is preferably formed of tubing, and a secondary single-turn winding in the form of a tubular coil form 12. In the preferred embodiment of the coil form 12, it is of a rectangular outline and has a rectangular opening 13 extending vertically therethrough. The height of the coil form 12 is determined by the size and number of turns in the primary coil 11.

At this time it is pointed out that the opposite sides of the coil form 12 are provided with a plurality of fins 14 which have defined therebetween grooves 15 into which the windings of the coil 11 are recessed. It will thus be seen that the relationship between the coil form and the windings of the coil is such so as to provide a large coupling area. Naturally, the increase in the area where the magnetic field is applied, increases the induced current. In addition, because the induced current is spread over a large area, the coil form losses are reduced.

It is to be understood that when the primary coil 11 and the secondary coil form 12 are assembled, and the ends of the primary coil 11 are connected to a HF generator, electrical current will be induced into the coil form. In order that the electrical energy induced into the coil form 12 may be directed into a preselected area of a workpiece, the heater 10 also includes a nosepiece 16. The nosepiece 16 is preferably in the form of a conductive plate, such as copper, and is provided with a raised portion 17. The nosepiece is mechanically and electrically secured to the upper face of the coil form 12 by means of suitable fasteners (not shown).

In order that the current induced into the coil form 12 may be forced to the nosepiece, the coil form is provided with an axial slot 18 which extends through the thickness thereof for the full height thereof. It will be readily apparent that all current flowing in the coil form 12 must produce closed loops and the induced current in the coil form 12 encountering the slot 18 will travel in any of three ways: up, down or horizontally along the inside surface. The determining factor for the direction of current flow is the inductance rather than the resistance of the assembly. Accordingly, the operating frequency is made high enough so that current opposition is in the form of an inductive reactance as opposed to a resistance. Therefore, since it is desirable to have the current go to the nosepiece, the nosepiece must have the lowest inductance. In order to enhance this flow, the slot must be wide enough to present flow series inductance with that of the nosepiece.

A ferrite core 20 is positioned within the opening 13 in the coil form 12 and provides the inside surface of the coil form with a high inductance. The core provides the means for carrying the magnetic flux to the nosepiece. There is a large current in the nosepiece which dictates a large magnetic flux. For plannar surfaces, the magnetic intensity is equal to the current per unit width. The ferrite core facilitates the transport of magnetic flux up to the nosepiece from the inside of the coil form and therefore must be capable of handling the flux density at the operating frequency.

It is to be understood that the nosepiece 16 carries the induced current towards the load and is essentially a low inductance short circuit. It is preferably constructive from copper plate and in the preferred embodiment of the invention, has a thickness of 0.2 inch. Further, the nosepiece 16 has a longitudinal slot 22 extending the full depth thereof with the slot extending substantially entirely across the nosepiece 16 and entirely across the raised portion 17. In the preferred embodiment of the invention, the slot 22 has a width of 0.03 inch. As is best shown in FIG. 2, the slot 22 is filled with a suitable filler 23 which includes a ferrite. Preferably the filler 23 is a ferrite-epoxy compound. The ferrite-epoxy compound facilitates the transport of magnetic flux from the core to the load.

With particular reference to FIG. 2, it will be seen that the nosepiece 16 has the upstanding portion 17 thereof formed by stamping. When the nosepiece is so formed, a recess 24 is formed in the underside of the nosepiece. This recess is filled with a further ferrite core 25 which has a continuation of the slot 22 formed therein and wherein the filler 23 for the slot 22 extends down into the core 25.

As will be apparent from FIG. 2, when there is associated with the nosepiece 16 a plate or sheet 26 which is to be locally heated in accordance with the configuration of the raised portion 17, the flux path is up through the ferrite material in the slot 22 and in opposite directions towards the periphery of the nosepiece. This is clearly indicated by arrows.

Figure 6:
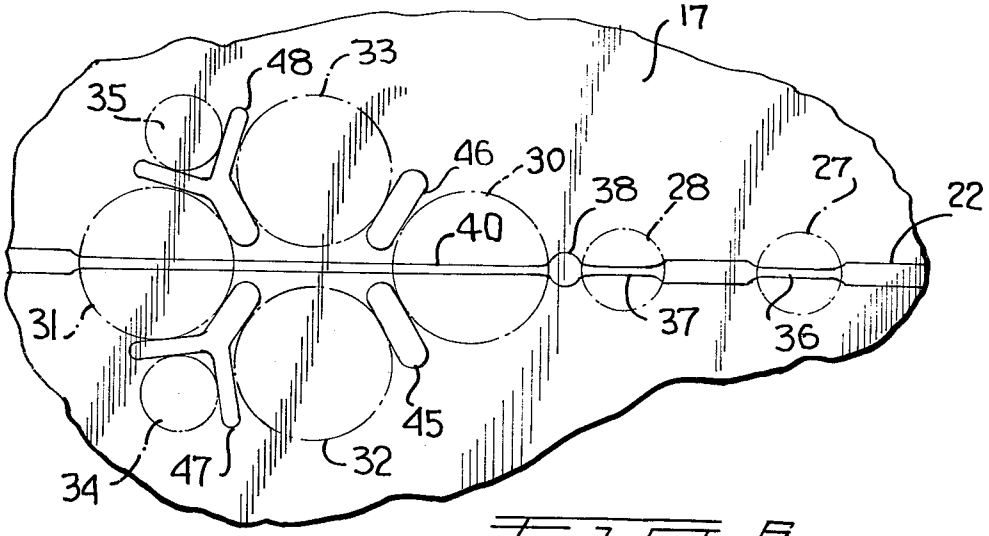
FIG. 6 is an enlarged fragmentary plan view of a portion of the nosepiece which is to be aligned with an end unit for the purpose of heating the face thereof to effect bonding of the sealing strip to the end unit and has superimposed thereon in phantom lines the arrangement of holes in the end unit.

If the portion of the plate 26 to be heated were free of perforations, etc., no further modification of the nosepiece 16 would be required. However, the plate 26, which is generally an end panel of an end unit for a container, may be provided with a pattern of holes or perforations. As illustrated in FIG. 6, these holes or perforations may include two smaller holes 27, 28 arranged in alignment, followed by two larger holes 30, 31 also in longitudinal alignment, but more widely spaced from one another. Disposed in transverse offset aligned relation between the holes 30, 31 is a pair of holes 32, 33. In addition, in diagonally offset relation transversely outwardly of the holes 31, 32 is a hole 34. A similar hole 35 is disposed in diagonally offset relation between the holes 31, 33. In order that there may be a uniform heating of the plate 26, notwithstanding the existance of the numerous holes therein, modifications are required in the nosepiece 16 in the area of the raised portion 17. First of all, it is to be understood that the current flow up through the slot 22, will be dependent primarily on the ability of the ferrite within the slot 22 to conduct the electrical current from the coil form 12 and the ferrite core 20. As is shown in enlarged detail in FIG. 3, where the holes 27, 28 are located in the plate 26, the slot 22 has been made of a reduced width, as at 36, 37, respectively. Thus the ferrite within the reduced width slot portions 36 and 37 has a lesser ability to accommodate current flow and therefore there is lesser current flow through the slot portions 36, 37 for flow transversely of the raised portion 17. Thus a generally uniform heating of the raised portion 17 in a transverse direction along its length is obtained. A like restrictive flow of electrical current could be obtained without reducing the width of the slot 22 by restricting the amount of ferrite placed in the slot.

When the holes are close together, such as the holes 28, 30, it may be desirable to increase the width of the slot 22 as at 38. Also, with the arrangement of the holes 30, 31, 32, 33, it is desirable that the slot be of a narrow width for the full extent of the holes as at 40.

As indicated above, the heating pattern on the load can be controlled by directing and proportioning the flux to various parts of the load. It is not necessary to couple flux to the open holes so, in that region, as described above, the central slot is narrow, producing a restricted amount of flux and less heating in those areas. For the region between the holes, the slot is wider, thereby producing more flux and a greater amount of heating.

Figure 4:
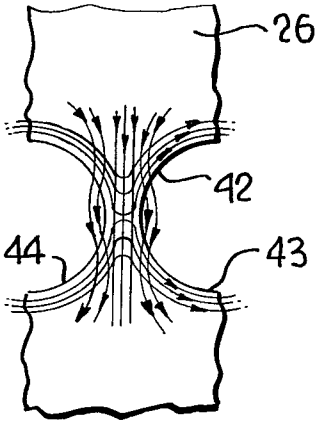
FIG. 4 is a schematic fragmentary view of the sheet which is to be heated by induction heating and shows the concentration of flux lines.

The hole arrangement effects the flux flow. The flux flow, as it emanates from the central slot, will follow the path of least reluctance. Therefore, if a flux path encounters two holes side-by-side, the flux will try to pass between the holes, as shown in FIG. 4. This produces a natural concentration of current between holes or in the web area. The flux lines going through the hole area, because of the air gap, are relatively low in intensity and bend towards the hole center. Most of the flux lines, however, are drawn to the area between the holes because of the higher permeability and corresponding lower reluctance path. Since the current is perpendicular, the current will also tend to concentrate in this area, thus causing overheating. It is believed that this is adequately shown by the flux lines in FIG. 4 passing through the web portion 42 extending between the adjacent holes 43, 44.

It has been found that this overconcentration of flux can be eliminated by milling grooves in the face of the raised portion 17. Such grooves are illustrated in FIG. 6 and include grooves 45 and 46 disposed between the holes 30, 32 on the one hand and the holes 30, 33 on the other hand. In a like manner, generally Y-shaped grooves 47 and 48, are milled in the surface of the raised portion 17 between the holes 31, 32 and 34 on the one hand and the holes 31, 33 and 35 on the other hand.

Figure 5:
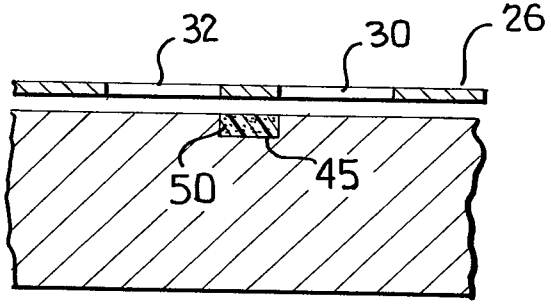
FIG. 5 is a fragmentary sectional view on a large scale through the nosepiece and shows the provision of a groove in the face thereof for the purpose of controlling current flow in the metal sheet in the area between two adjacent holes.

With particular reference to FIG. 5, it will be seen that it is desirable that the groove 45 be filled with a suitable filler 50 which may be epoxy. The purpose of the filler 50 is to prevent metal chippings from dropping in and filling the grooves.

It is to be understood that the increased gap, resulting from the milling of a groove in the face of the raised portion 17 in alignment with the area between the holes, now provides just above the milled groove, an area with a higher air gap and reluctance. Thus, the increased gap is at that point where the flux naturally tends to concentrate so as to negate this concentration. It is pointed out here that it has been found that a groove depth on the order of 50 mils is satisfactory.

At this time it is pointed out that the configuration of the slot 22 and the grooves or slots milled in the face of the raised portion 17 is particularly designed for use with a steel workpiece. It is also to be understood that the configuration of the slot and the arrangement of the milled grooves is different for an aluminum sheet. This is due to the phenomena where high frequency currents flow on the surface as opposed to penetrating the full thickness of the workpiece. Also, the surface of steel will conduct flux more readily than aluminum. For example, the relative permeability of steel at the high flux density involved in accordance with this invention will be on the order of 100 to 200 as opposed to a relative permeability of 1 for aluminum. As a result, the depth of the current flow along the skin of steel is much less than that of aluminum. Also, most of the flux will flow through the steel as opposed to through the air in the air gap between the workpiece and the nosepiece. At a working frequency on the order of 350kHz, the penetration of the current in steel will be on the order of 1 mil whereas with the same frequency, the penetration of the current into the aluminum will be on the order of $5\frac{1}{2}$ mils.

The net result of the foregoing is that there is more of a concentration of current in the area between the holes with steel than with aluminum. For this reason, you need a different pattern with aluminum than that described above with respect to FIG. 6 as used with steel.

Figure 7:
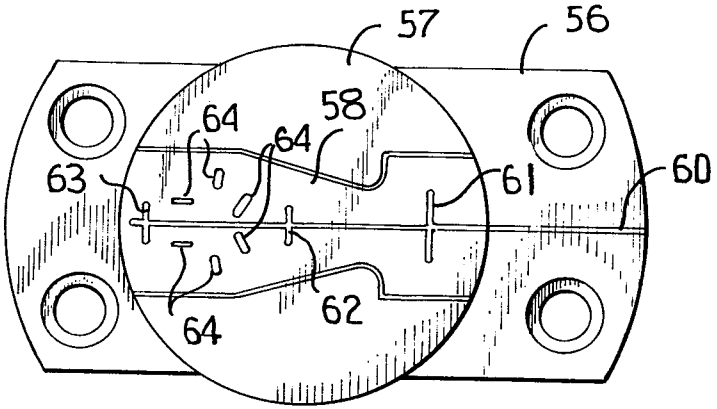
FIG. 7 is a plan view of an end piece particularly adapted for use in conjunction with an end unit formed of aluminum, the nosepiece being rotated approximately 180° from the nosepiece of FIG. 1 and being usable in lieu thereof.

Referring now to FIG. 7, it will be seen that there is illustrated a nosepiece 56 which is particularly adapted for use with aluminum. The nosepiece 56 includes a first raised portion 57 which is circular in outline and which is intended to be received within the recessed customary end unit for alignment purposes. The raised portion 57, in turn, has a raised portion 58 which corresponds to the raised or elevated portion 17 of the nosepiece 16.

The nosepiece 56 has a longitudinal slot 60 extending therethrough from one end thereof. However, in order to obtain proper flux flow, the raised portion 58 is provided with three slots 61, 62 and 63 which extend transversely of the slot 60. The slots 61, 62 and 63 extend the full depth of the nosepiece 56 and like the slot 60 is filled with a filler including a ferrite, the filler preferably being a ferrite-epoxy mixture as described above. It is to be understood that the slots 61, 62 and 63 are coordinated with the pattern of holes shown in FIG. 6.

In addition, the surface of the raised portion 58 is milled to provide a plurality of slots or grooves 64 which are arranged in a pattern so as to be between adjacent ones of the holes illustrated in FIG. 6.

At this time it is pointed out that nominally, the temperature of the raised portion of the nosepiece is on the order of 400° F. The proximity between the nosepiece and the workpiece is one factor. The raised portion 17 is non-uniformly heated in that it is desired to heat essentially only those areas of the workpiece wherein there are no holes. There is no advantage in applying heat to the areas of the workpiece which are in the form of holes. The entire purpose of the device is to apply a uniform heat to the workpiece with the temperature being sufficient to effect the melting of the adhesive carried by the sealing strip (not shown) which is to be applied.

Referring once again to FIG. 1, it will be seen that a high frequency generator 66 is coupled to the coil 11. As indicated above, the invention has been successfully operated at a frequency on the order of 350 kHz and the HF generator 66 should have at least that capacity.

It is also pointed out here that there is a realtively great heat loss involved. Accordingly, a coolant may be circulated through the coil 11 in the customary manner. In a like manner, the coil form 12 and the nosepiece 16 may have suitable coolant openings therein. For example, a coolant cavity may be formed in the end portions of the coil form 12 and the nosepiece 16 opposite the slot 18.

It is pointed out here that although the holes in the workpiece 17 illustrated in the drawings are all circular, the invention is not so restricted to such a configuration of holes. The holes may be of various configurations. It is also to be understood that with various hole arrangements and hole configurations in sizes, it will be necessary to modify each nosepiece in accordance with the same so as to have varieties of slot and milled groove arrangements in order to compensate for the holes and to provide for uniform heating of the workpiece adjacent the holes.

Although only a preferred embodiment of the invention has been specifically illustrated and described here, it is to be understood that minor variations may be made in the invention without departing from the spirit and scope thereof as defined by dependent claims.

I claim:

1. A flux concentrator for induction heating of preselected areas of metal plates, said flux concentrator comprising a transformer; said transformer comprising a single winding secondary coil form in the form of a thick wall tubular body of a selected height, said body having remote end faces, said body being interrupted by an axial slot extending from the exterior of said body to the interior thereof for the full height of said body, and a multiple winding primary coil wrapped around the exterior of said secondary coil form with the windings of said primary coil bridging said slot; and a nosepiece overlying one of said coil form end faces in electrical conducting relation, said nosepiece being in the form of a generally axially coextensive cover plate for said coil form and having a longitudinal slot therein for the full height thereof, said nosepiece slot being in alignment with said coil form slot with a portion of said nosepiece slot forming an axial extension of said coil form slot.

2. The flux concentrator of claim 1 wherein said coil form slot is in the form of an air gap.

3. The flux concentrator of claim 1 wherein said coil form slot is in the form of an air gap and said nosepiece slot is filled with a filler including ferrite.

4. The flux concentrator of claim 1 wherein said coil form has outwardly extending vertically spaced fins defining therebetween recesses for said primary coil windings to provide for a maximum coupling between said primary coil windings and said secondary coil form.

5. The flux concentrator of claim 1 wherein said coil form is substantially filled with a core, and said nosepiece opposes one end of said core.

6. The flux concentrator of claim 1 wherein said nosepiece has a raised portion of a shape in accordance with the shape of that area of a metal plate intended to be heated.

7. The flux concentrator of claim 1 wherein said flux concentrator is used to heat metal plates having holes therethrough, said nosepiece has a face remote from said coil form adapted to oppose said metal plates, and said nosepiece face having recesses therein for alignment with portions of plates between adjacent holes to concentrate heating in such plate portions.

8. The flux concentrator of claim 7 wherein said endpiece slot is of a decreased width in a selected pattern in accordance with the pattern of holes in said metal plates.

9. The flux concentrator of claim 7 wherein said nosepiece slot includes transverse portions in a selected pattern in accordance with the pattern of holes in said metal plates.

10. The flux concentrator of claim 7 wherein said nosepiece slot is filled with a filler including ferrite, and the ferrite in portions of said nosepiece slot is varied in accordance with the patterns of holes in the plates.

11. The flux concentrator of claim 1 wherein said flux concentrator is used to heat metal plates having holes therethrough, and said nosepiece slot is of a decreased width in a selected pattern in accordance with the pattern of holes in said metal plates.

12. The flux concentrator of claim 1 wherein said flux concentrator is used to heat metal plates having holes therethrough, and said endpiece slot includes transverse portions in a selected pattern in accordance with the pattern of holes in said metal plates.

13. A method of heating metal plates uniformly each in an area thereof having a preselected pattern of holes, said method comprising the steps of providing a flux concentrator having a nosepiece, configurating the nosepiece to have a central raised portion in accordance with the plate area to be heated, patterning the surface of a face of the raised portion to present a higher inductance in alignment with areas of a plate between the holes therein, providing the nosepiece with a slot extending longitudinally through the raised portion for the full depth thereof, positining one of the metal plates against the raised portion, and uniformly heating the metal plate by introducing high frequency electrical energy into the nosepiece raised portion.

14. The method of claim 13 wherein the slot is filled with a filler including ferrite, and the high frequency electrical energy is directed into the slot for flow therefrom.

15. The method of claim 14 wherein the patterning of the face of the nosepiece includes the varying of width of the slot in accordance with the pattern of holes along the slot.

16. The method of claim 14 wherein the patterning of the face of the nosepiece includes forming recesses in the face in accordance with the pattern of holes.

* * * * *